US007364496B2

(12) United States Patent
Berkstresser et al.

(10) Patent No.: US 7,364,496 B2
(45) Date of Patent: Apr. 29, 2008

(54) POLISHING HEAD FOR POLISHING SEMICONDUCTOR WAFERS

(75) Inventors: David E. Berkstresser, Los Gatos, CA (US); Jerry J. Berkstresser, San Jose, CA (US); Jino Park, San Jose, CA (US); In-Kwon Jeong, Cupertino, CA (US)

(73) Assignee: Inopla Inc., San Jose, CA (US)

( * ) Notice: Subject to any disclaimer, the term of this patent is extended or adjusted under 35 U.S.C. 154(b) by 0 days.

(21) Appl. No.: 11/680,588

(22) Filed: Feb. 28, 2007

(65) Prior Publication Data

US 2007/0207709 A1 Sep. 6, 2007

Related U.S. Application Data

(60) Provisional application No. 60/844,737, filed on Sep. 15, 2006, provisional application No. 60/837,109, filed on Aug. 11, 2006, provisional application No. 60/834,890, filed on Aug. 1, 2006, provisional application No. 60/800,468, filed on May 15, 2006, provisional application No. 60/778,675, filed on Mar. 3, 2006.

(51) Int. Cl.
*B24B 7/22* (2006.01)

(52) U.S. Cl. ..... 451/41; 451/388; 451/289

(58) Field of Classification Search ..... 451/388, 451/398, 288, 289, 287, 41
See application file for complete search history.

(56) References Cited

U.S. PATENT DOCUMENTS

| | | | | |
|---|---|---|---|---|
| 5,423,716 | A | 6/1995 | Strasbaugh | |
| 5,584,746 | A | 12/1996 | Tanaka et al. | |
| 5,605,488 | A | 2/1997 | Ohashi et al. | |
| 5,624,299 | A | 4/1997 | Shendon | |
| 5,820,448 | A | 10/1998 | Shamouilian et al. | |
| 6,056,632 | A * | 5/2000 | Mitchel et al. | 451/288 |
| 6,106,378 | A * | 8/2000 | Perlov et al. | 451/288 |
| 6,183,354 | B1 | 2/2001 | Zuniga et al. | |
| 6,277,009 | B1 * | 8/2001 | Chen et al. | 451/288 |
| 6,558,232 | B1 * | 5/2003 | Kajiwara et al. | 451/41 |
| 6,722,965 | B2 * | 4/2004 | Zuniga et al. | 451/288 |
| 6,776,694 | B2 * | 8/2004 | Zuniga et al. | 451/41 |
| 6,852,019 | B2 * | 2/2005 | Togawa et al. | 451/288 |
| 7,121,934 | B2 * | 10/2006 | Jung | 451/285 |
| 2002/0094766 | A1 * | 7/2002 | Zuniga et al. | 451/287 |

* cited by examiner

*Primary Examiner*—Robert Rose
(74) *Attorney, Agent, or Firm*—Thomas H. Ham; Wilson & Ham

(57) ABSTRACT

A polishing head and method for handling and polishing semiconductor wafers uses a base structure with at least one recess region and an outer flexible membrane that can conform to the at least one recess region to form at least one depression to hold a semiconductor wafer onto the outer flexible membrane when suction is applied to the at least one depression.

26 Claims, 12 Drawing Sheets

POLISHING HEAD FOR POLISHING SEMICONDUCTOR WAFERS

CROSS REFERENCE TO RELATED APPLICATION

This application is entitled to the benefit of U.S. Provisional Patent Application Ser. No. 60/778,675, filed on Mar. 3, 2006, 60/800,468, filed on May 15, 2006, 60/834,890, filed on Aug. 1, 2006, 60/837,109, filed on Aug. 11, 2006 and 60/844,737, filed on Sep. 15, 2006, which are all incorporated herein by reference.

FIELD OF THE INVENTION

The invention relates generally to semiconductor processing equipments, and more particularly to a polishing head and method for handling and polishing semiconductor wafers.

BACKGROUND OF THE INVENTION

Local and global planarization of semiconductor wafers becomes increasingly important as more metal layers and interlayer dielectric layers are stacked on the wafers. A preferred method to planarize semiconductor wafers is the chemical mechanical polishing (CMP) method, where a surface of a semiconductor wafer is polished using a slurry solution supplied between the wafer and a polishing pad. The CMP method is also widely used for damascene process to form copper structures on the semiconductor wafers.

In general, a CMP equipment includes a polishing table where a polishing pad is placed and a wafer carrier that supports a semiconductor wafer and presses the wafer against the polishing pad. The CMP equipment may also include a wafer cleaner to clean and dry the polished wafers.

An important component of a CMP equipment is the polishing head that holds a semiconductor wafer to be polished on a polishing surface. The polishing head is designed to chuck (load) and de-chuck (unload) the wafer, and to apply pressure to the wafer onto the polishing surface. After a wafer is polished, a strong bond may exist between the wafer and the polishing surface, which makes chucking the wafer onto the polishing head challenging. The polishing head must be designed to overcome this bond between the wafer and the polishing surface to chuck the wafer onto the polishing head. During the wafer polishing, the polishing head must apply proper pressure to the wafer to minimize uneven polishing.

In view of the above issues, what is needed is a polishing head and method for handling and polishing semiconductor wafers that overcomes these issues to properly handle and polish the wafers.

SUMMARY OF THE INVENTION

A polishing head and method for handling and polishing semiconductor wafers uses a base structure with at least one recess region and an outer flexible membrane that can conform to the at least one recess region to form at least one depression to hold a semiconductor wafer onto the outer flexible membrane when suction is applied to the at least one depression. The at least one depression allows a wide area of the wafer to be subjected to the applied suction to secure the wafer onto the outer flexible membrane.

A polishing head in accordance with an embodiment of the invention comprises a base structure, an outer flexible membrane, a first fluid channel and a second fluid channel. The base structure has a lower surface. The base structure is configured to include at least one recess region on the lower surface. The outer flexible membrane is positioned below the base structure. The outer flexible membrane and the base structure define a chamber below the base structure. The first fluid channel is operatively connected to the chamber to apply suction to at least a portion of the chamber. The suction causes the outer flexible membrane to conform to the at least one recess region of the base structure such that at least one depression is formed on a bottom surface of the outer flexible membrane. The second fluid channel is configured to extend through the outer flexible membrane such that an opening of the second fluid channel is positioned in the at least one depression when the suction is applied to the chamber. The second fluid channel is used to apply another suction to the at least one depression to hold a semiconductor wafer onto the outer flexible membrane.

A method for handling and polishing a semiconductor wafer in accordance with an embodiment of the invention comprises moving the polishing head such that an outer flexible membrane of the polishing head is at least in close proximity to a surface of the semiconductor wafer, applying suction to at least a portion of a chamber of the polishing head defined by the outer flexible membrane and a base structure of the polishing head, the base structure being configured to include at least one recess region on a lower surface of the base structure, the applying of the suction to at least a portion the chamber causing the outer flexible membrane to conform to the at least one recess region of the base structure such that at least one depression is formed on a bottom surface of the outer flexible membrane, and applying another suction to the at least one depression on the bottom surface of the outer flexible membrane to hold the semiconductor wafer onto the outer flexible membrane of the polishing head.

Other aspects and advantages of the present invention will become apparent from the following detailed description, taken in conjunction with the accompanying drawings, illustrated by way of example of the principles of the invention.

DETAILED DESCRIPTION

Figure 1:
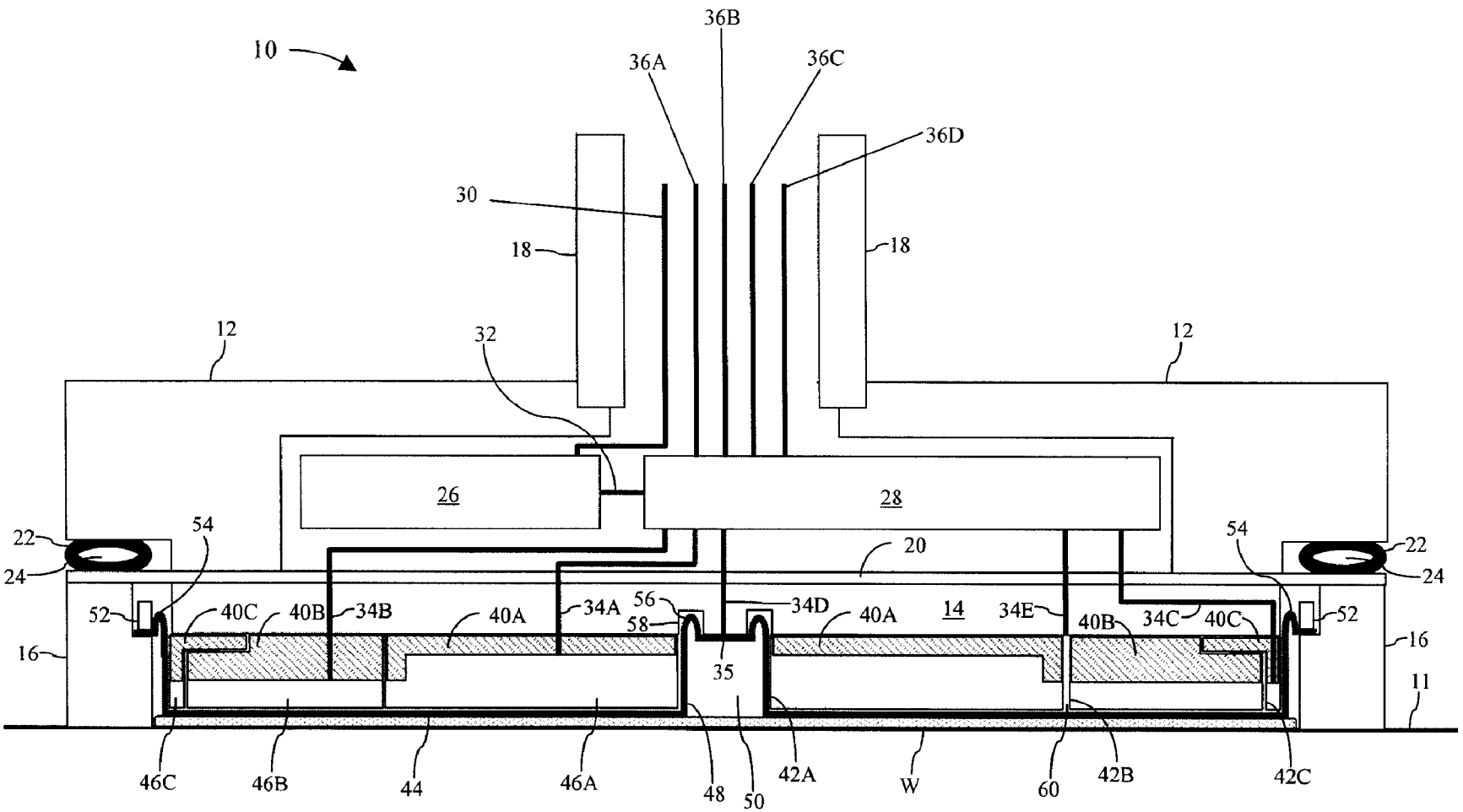
FIG. 1 is a vertical cross-sectional view of a polishing head in accordance with an embodiment of the present invention.

With reference to FIG. 1, a polishing head 10 for polishing a semiconductor wafer W according to an embodiment of the present invention is described. FIG. 1 is a vertical cross-sectional view of the polishing head 10 after it is assembled. The polishing head 10 is used to remove material from the wafer that is being polished. The polishing head 10 is configured to hold the wafer and polish it by rotating and pressing the wafer on a polishing surface 11. Abrasive slurry and/or chemical can be used during the polishing of the wafer.

The polishing head 10 includes a housing 12, a base 14 and a retainer ring 16. The housing 12 is connected to a drive shaft 18, which is used to move and rotate the polishing head 10. The drive shaft 18 is connected to a motor (not shown) that rotates the drive shaft. The drive shaft 18 is also connected to a vertical drive mechanism (not shown), such as a pneumatic actuator, to displace the polishing head 10 vertically toward the polishing surface 11. The base 14 is connected to the housing 12 via a flexure 20.

The flexure 20 is a thin circular disc made of a flexible material. As an example, the flexure 20 can be a thin metal circular disc. However, the flexure 20 can be made of other flexible materials. The interior region of the flexure 20 is attached to the housing 12 and the base 14 using joint screws, adhesive material or any other means to physically attach the flexure to the housing and the base. The outer edge of the flexure 20 is attached to the retainer ring 16 using joint screws, adhesive material or any other means to physically attach the flexure to the retainer ring. The flexure 20 is configured to be reversibly flexible in a vertical manner. The flexure 20 is further configured to bear shear stress applied to the flexure in a parallel manner to the base 14.

The polishing head 10 further includes an annular tube 22, which is positioned over the retainer ring 16 between the housing 12 and the flexure 20. The annular tube 22 is attached to the housing 12 and the retainer ring 16 through the flexure 20. The annular tube 22 is a sealed tube such that the interior region of the tube contains a fluid 24, such as air, water, oil, silicon, gelatin or other gas or liquid, at a predefined pressure. The fluid 24 may be a viscous material.

The annular tube 22 is pressurized when a downward force is applied to the annular tube by the housing 12 at a time when the retainer ring 16 is in contact with the polishing surface 11. The pressurized annular tube 22 transfers the downward force to the retainer ring 16. In an embodiment, the annular tube 22 is made of elastic material such that the tube is not subject to permanent deformation during repeated pressing processes of the retainer ring 16 against the polishing surface 11.

When the retainer ring 16 presses the polishing surface 11, the annular tube 22 operates as a vibration absorber. The vibrations generated during a polishing process of the wafer W due to friction between the polishing surface 11 and the bottom surface of the retainer ring 16 are absorbed by the annular tube 22. Therefore, the vibrations that are transferred to the housing 12 of the polishing head 10 can be minimized.

Since the pressure of the fluid 24 in the annular tube 22 does not have to be controlled to adjust the pressure applied to the polishing surface 11 through the retainer ring 16, the annular tube 22 does not have to be connected to any fluid source in the polishing head 10. However, in other embodiments, the annular tube 22 can be connected to a fluid source in the polishing head 10 such that the fluid 24 can be supplied to the tube or removed from the tube to control the volume of the fluid in the tube.

The polishing head 10 further includes a controller 26 and a valve-and-regulator assembly 28. In the illustrated embodiment, the controller 26 and the valve-and-regulator assembly 28 are situated within the housing 12 above the base 14. The controller 26 is configured to control the components of the valve-and-regulator assembly 28, as described below. The controller 26 is connected to an external controller (not shown), which may be a computer system, via wires 30 for power and data communication. The controller 26 is also connected to the valve-and-regulator assembly 28 via wires 32 for power and data communication. The valve-and-regulator assembly 28 is connected to fluid channels 36A-36D. The fluid channel 36A is used to receive pressurized gas, such as air. The fluid channel 36B is used as an exhaust to release excess gas. The fluid channel 36C is used to provide vacuum or suction. The fluid channel 36D is used to receive deionized (D.I.) water. The valve-and-regulator assembly 28 is also connected to a number of fluid channels 34A-34E, which are described below.

The polishing head 10 also includes a first annular disc 40A, a second annular disc 40B, a third annular disc 40C, a first inner annular flexible membrane 42A, a second inner annular flexible membrane 42B, a third inner annular flexible membrane 42C and an outer flexible membrane 44. The first, second and third annular discs 40A-40C are attached to the base 14 using joint screws, adhesive material or any other means to physically attach the annular discs to the base. The first, second and third annular discs 40A-40C are positioned within the confines of the retainer ring 16. The base 14 and the annular discs 40A-40C form a base structure of the polishing head 10.

Figure 3A:
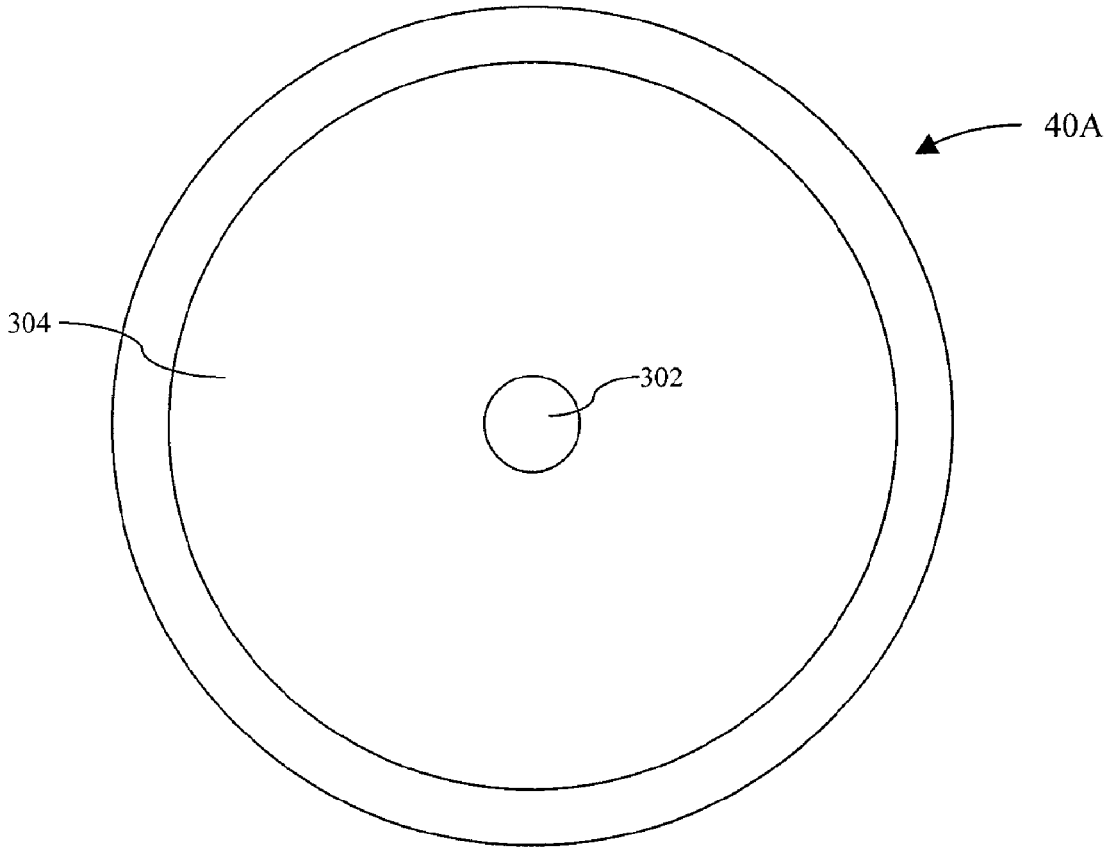
FIG. 3A is a bottom view of a first annular disc of the polishing head of FIG. 1 in accordance with an embodiment of the invention.
Figure 3B:
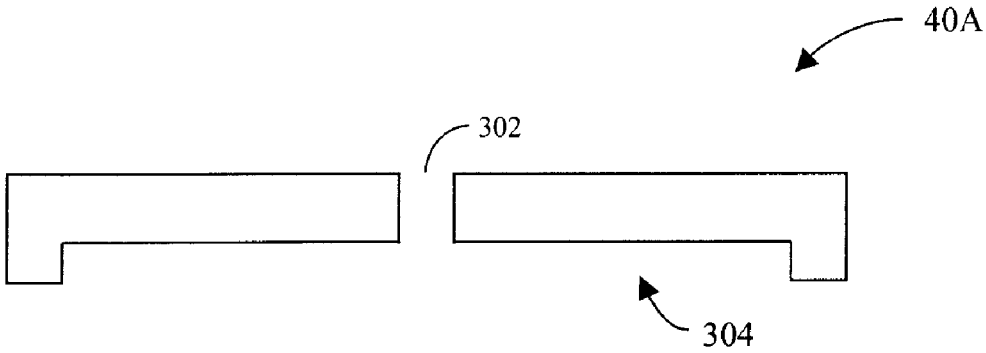
FIG. 3B is a cross-sectional view of the first annular disc of FIG. 3A.

The first annular disc 40A is shown in more detail in FIGS. 3A and 3B. FIG. 3A is a bottom view of the first annular disc 40A, while FIG. 3B is a cross-sectional view of the first annular disc. As shown in FIGS. 3A and 3B, the first annular disc 40A includes a circular hole 302 at its center and a circular recess region 304 on its bottom surface. The circular recess region 304 is positioned about the circular hole 302 such that the circular hole is positioned at the center of the circular recess region 304. Some of the advantages of the configuration of the first annular disc 40A are described below.

Turning back to FIG. 1, the inner and outer diameters of the first, second and third annular discs 40A-40C at their bottom surfaces are determined such that the third annular disc 40C surrounds the second annular disc 40B, and the second annular disc 40B surrounds the first annular disc 40A. In an embodiment, the outer edge of the second annular disc 40B is configured to have a step and the inner edge of the third annular disc 40C is configured to have an inverted step. Thus, the outer edge of the second annular disc 40B and the inner edge of the third annular disc 40C can be fitted together to interlock the second and third annular discs. Some of the advantages of the configuration of the second and third annular discs 40B and 40C are described below.

The first inner annular flexible membrane 42A is connected to the first annular disc 40A such that a first annular chamber 46A is defined by the first annular disc 40A and the first inner annular flexible membrane 42A. The second inner annular flexible membrane 42B is connected to the second annular disc 40B such that a second annular chamber 46B is defined by the second annular disc 40B and the second inner annular flexible membrane 42B. The third inner annular flexible membrane 42C is connected to the third annular disc 40C such that a third annular chamber 46C is defined by the third annular disc 40C and the third inner annular flexible membrane 42C. The first, second and third inner annular flexible membranes 42A-42C can be bonded to their respective annular discs 40A-40C using adhesive material. When one or more of the inner annular flexible membranes 42A-42C need to be changed, the respective annular discs 40A, 40B and/or 40C that have the respective bonded inner annular flexible membranes can be changed.

Figure 4A:
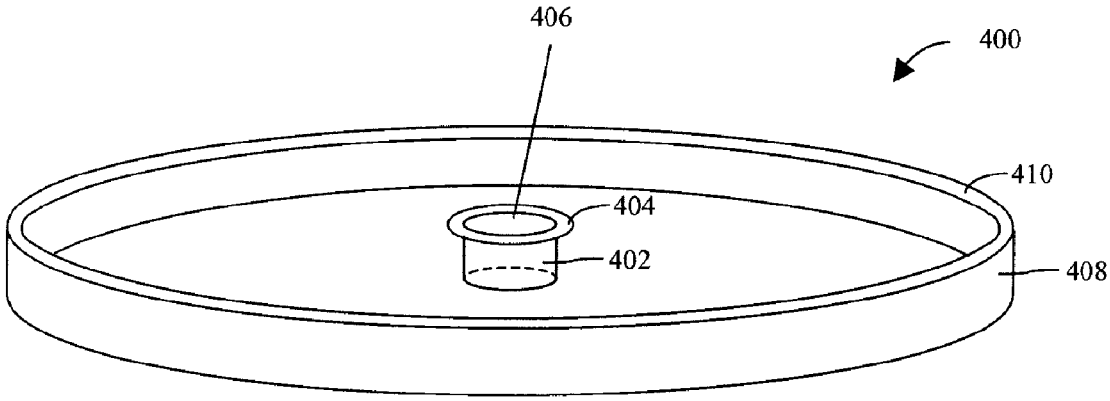
FIG. 4A is a perspective view of an inner annular flexible membrane of the polishing head of FIG. 1 in accordance with an embodiment of the invention.
Figure 4B:
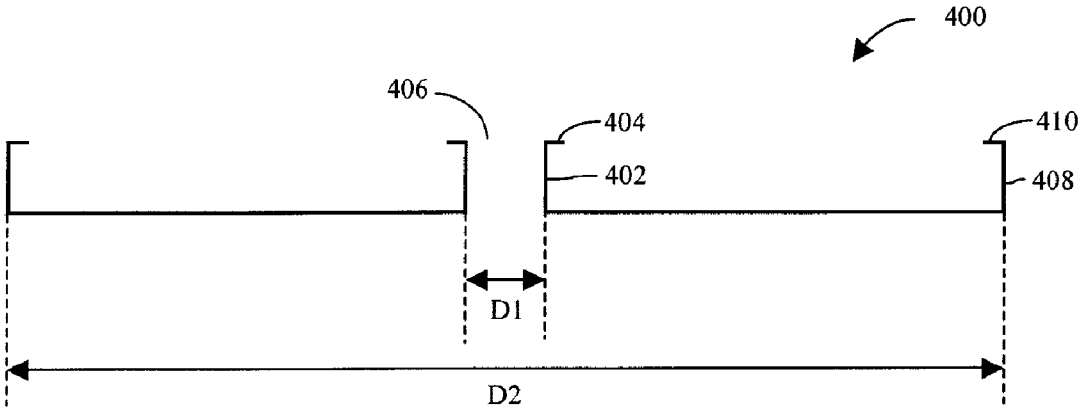
FIG. 4B is a cross-sectional view of the inner annular flexible membrane of FIG. 4A.

An example of an inner annular flexible membrane 400 is illustrated in FIG. 4A and 4B. As shown in FIGS. 4A and 4B, the inner annular flexible membrane 400 includes an inner circular sidewall 402 with a circular top flap 404 that extends outward away from the center of the membrane. The inner annular flexible membrane 400 also includes an outer circular sidewall 408 with a circular top flap 410 that extends inward toward the center of the membrane. The circular top flaps 404 and 410 are used to secure the inner annular flexible membrane 400 to the respective annular disc 40A, 40B or 40C. The inner circular sidewall 402 defines a circular aperture 406 at the center of the inner annular flexible membrane 400. The size of the aperture 406 corresponds to the inner diameter D1 of the inner annular flexible membrane 400. The outer circular sidewall 408 defines the outer diameter D2 of the inner annular flexible membrane 400. The inner and outer diameters D1 and D2 of the inner annular flexible membrane 400 depend on whether the inner annular flexible membrane is to be used as the first flexible membrane 42A, the second flexible membrane 42B or the third flexible membrane 42C of the polishing head 10.

Even though the polishing head 10 is illustrated and described as comprising the three annular chambers 46A-46C associated with their respective annular discs 40A-40C, the polishing head 10 can be configured to comprise other number of annular chambers associated with their respective annular discs in other embodiments.

Turning back to FIG. 1, the outer flexible membrane 44 is attached to the base 14 and the retainer ring 16 such that the outer flexible membrane covers the first, second and third inner annular flexible membranes 42A, 42B and 42C. In the illustrated embodiment, the outer flexible membrane 44 is configured to include a circular recess region 48 at its center that conforms to the center circular hole of the first annular disc 40A. The circular recess region 48 of the outer flexible membrane 44 forms a circular central cavity 50. The center of the outer flexible membrane 44 is attached to the base 14 using an adhesive material, one or more joint screws or any other means to physically attach the outer flexible membrane to the base. The outer edge of the outer flexible membrane 44 is attached to the retainer ring 16 using one or more outer membrane holders 52, which may be joint screws. In other embodiments, the outer edge of the outer flexible membrane 44 may be attached to the retainer ring 16 using an adhesive material or any other means to physically attach the outer flexible membrane to the retainer ring. The outer flexible membrane 44 and the annular discs 40A-40C define a large annular chamber, which contains the annular chambers 46A-46C created by the inner annular flexible membranes 42A-42C.

The outer flexible membrane 44 is configured to have an annular periphery portion 54 and an annular central portion 56. The annular periphery portion 54 is shaped to have an annular upside down U-shape such that the annular periphery portion is situated between the base 14 and the retainer ring 16. The annular central portion 56 of the outer flexible membrane 44 is also shaped to have an annular upside down U-shape such that the top of the upside down U-shaped portion 56 faces an annular recess 58 that is formed near the center of the base 14. The upside down U-shaped portions 54 and 56 are made to keep their shape reversibly after repeated changes of their shape. The upside down U-shaped portions 54 and 56 of the outer flexible membrane 44 allow the outer flexible membrane 44 to expand downward toward the wafer W and to contract upward away from the wafer without having to stretch or without having to stretch significantly. Thus, the outer flexible membrane 44 can be made of inelastic material and still function properly, i.e., expand and contract. However, in some embodiments, the outer flexible membrane 44 can still be made of elastic material.

The bottom surface of the outer flexible membrane 44 is used as the surface that contacts the wafer W. The outer flexible membrane 44 and the first, second and third inner annular flexible membranes 42A-42C can be made of any flexible materials including rubbers and plastic materials. In some embodiments, plastic material such as PVC, Polystyrene, Nylon, and Polyethylene is used for the first, second and third inner annular flexible membranes 42A-42C. In some embodiments, elastic material such as rubber, elastomer, silicon rubber, and polyurethane rubber is used for the outer flexible membrane 44. In other embodiments, non-elastic material is used for the outer flexible membrane 44.

In some embodiments, the thicknesses of the first, second and third inner annular flexible membranes 42A-42C are substantially thinner than the thickness of the outer flexible membrane 44. By using thin flexible membranes for the first, second and third inner annular flexible membranes 42A-42C, any pressure differential at the boundaries of the inner flexible membranes 42A-42C on the outer flexible membrane 44 and the wafer W by the first, second and third inner annular flexible membranes 42A-42C is minimized. As an example, the first, second and third inner annular flexible membranes 42A-42C can be films with thicknesses less than 0.2 mm. In this example, the outer flexible membrane 44 can be a film with a thickness greater than 0.5 mm. As another example, the first, second and third inner annular flexible membranes 42A-42C can be films with thicknesses between 0.06 mm and 0.09 mm. In this example, the outer flexible membrane 44 can be a film with a thickness between 0.6 and 0.9 mm.

Figure 2:
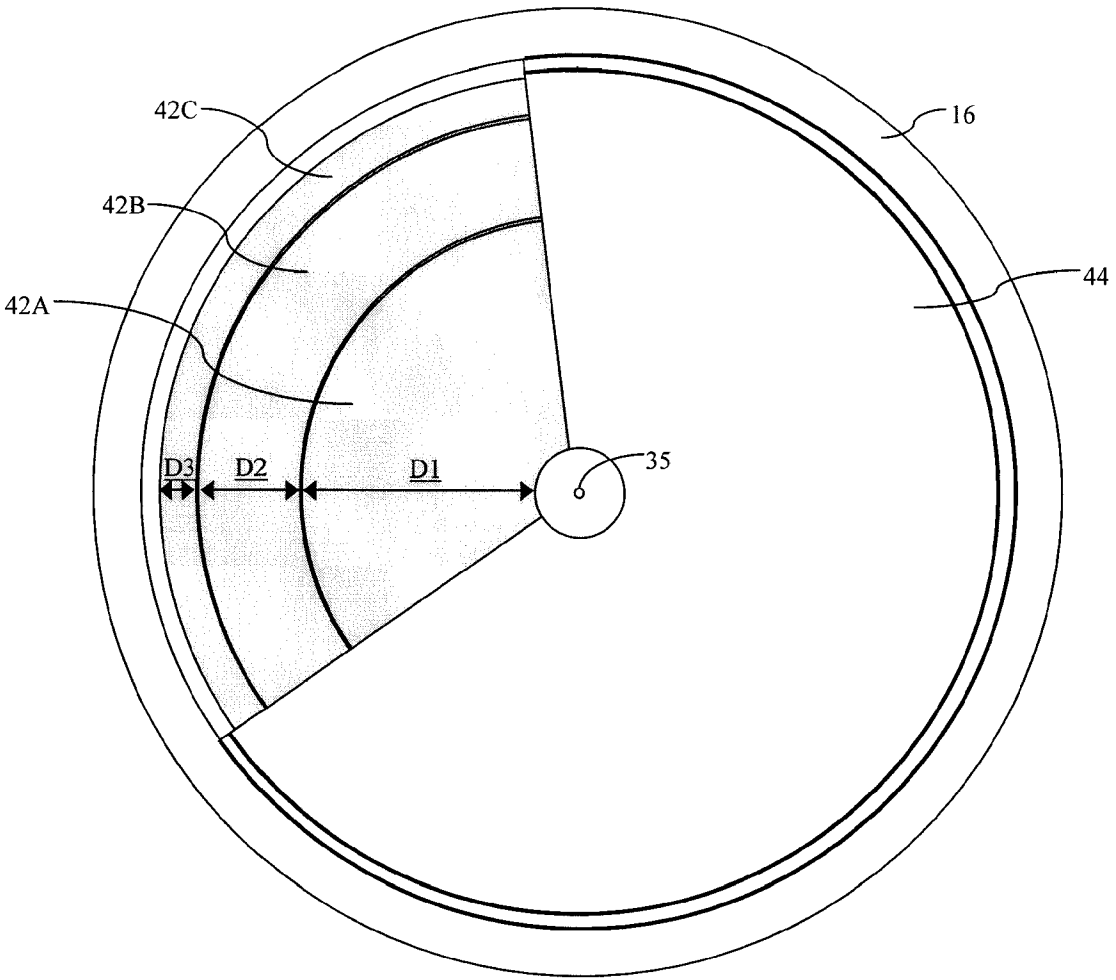
FIG. 2 is a bottom view of the polishing head of FIG. 1 with an outer flexible membrane being partially cut away to show first, second and third inner annular flexible membranes in accordance with an embodiment of the invention.

The outer flexible membrane 44 and the first, second and third inner annular flexible membranes 42A-42C are shown in FIG. 2, which is a bottom view of the polishing head 10 with the outer flexible membrane being partially cut away to show the first, second and third inner annular flexible membranes. As illustrated in FIG. 2, D1, D2 and D3 are widths of the first, second and third inner annular flexible membranes 42A-42C, respectively, and thus, the widths of the annular chambers 46A-46C, respectively, which are defined by the first, second and third inner annular flexible membranes 42A-42C. These widths D1, D2 and D3 also correspond to the widths of the first, second and third annular discs 40A-40C, respectively. Thus, by adjusting the widths D1, D2 and D3 of the discs 40A-40C, the widths of the annular chambers 46A-46C associated with the respective discs can be adjusted.

Turning back to FIG. 1, the first annular disc 40A and the base 14 comprise at least one fluid channel 34A such that the first annular chamber 46A is connected to the valve-and-regulator assembly 28 via the fluid channel 34A to receive pressurized gas. The second annular disc 40B and the base 14 comprise at least one fluid channel 34B such that the second annular chamber 46B is connected to the valve-and-regulator assembly 28 via the fluid channel 34B to receive pressurized gas. The third annular disc 40C and the base 14 comprise at least one fluid channel 34C such that the third annular chamber 46C is connected to the valve-and-regulator assembly 28 via the fluid channel 34C to receive pressurized gas. The pressurized gas may include air, nitrogen or a combination of different gases. The valve-and-regulator assembly 28 controls the pressure of the gas such that gas having different pressures can be supplied to the first, second and third annular chambers 46A-46C through the respective fluid channels 34A-34C.

The base 14 also comprises a central fluid channel 34D, which connects the central cavity 50 to the valve-and-regulator assembly 28 through the outer flexible membrane 44 to apply a vacuum/suction and to provide DI water to the central cavity 50. The fluid channel 34D includes an opening 35, which is located at the center of the outer flexible membrane 44, and extends through outer flexible membrane. The base 14 further comprises at least one fluid channel 34E, which connects a space 60 between the outer flexible membrane 44 and the inner annular flexible membranes 42A-42C to the valve-and-regulator assembly 28 to apply a vacuum/suction to the space 60. The fluid channel 34E allows a vacuum/suction to be applied to the space 60 so that the annular chambers 46A-46C can be efficiently deflated when needed.

Figure 5:
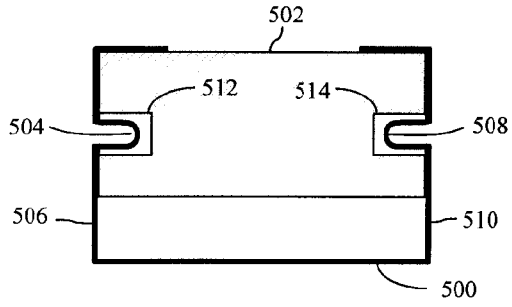
FIG. 5 is a cross-sectional view of an annular disc and an inner annular flexible membrane in accordance with an embodiment of the invention.

In an embodiment, at least some of the inner annular flexible membranes 42A-42C are configured to include annular wrinkled portions to allow the membranes to expand and contract without having to stretch or without having to stretch significantly. FIG. 5 shows a cross-section of an inner annular flexible membrane 500 attached to an annular disc 502. The membrane 500 is configured to include an annular wrinkled portion 504 on an inner sidewall 506 of the membrane and an annular wrinkled portion 508 on an outer sidewall 510 of the membrane. The wrinkled portion 504 on the inner sidewall 506 is configured to protrude outward toward the outer sidewall 510 or toward the annular disc 502. The wrinkled portion 508 on the outer sidewall 510 is configured to protrude inward toward the inner sidewall 506 or toward the annular disc 502. Thus, the wrinkled portions 504 and 508 both protrude toward the annular disc 502. In this embodiment, the wrinkled portion 504 of the membrane 500 faces an annular recess 512 that is formed at an inner side of the annular disc 502. The wrinkled portion 508 of the membrane 500 faces an annular recess 514 that is formed at an outer side of the annular disc 502. The wrinkled portions 504 and 508 of the inner annular membrane 500 serve a similar function as the upside down U-shaped portions 54 and 56 of the outer flexible membrane 44. The wrinkled portions 504 and 508 of the inner annular membrane 500 allow the membrane 500 to expand downward toward the wafer W (not shown in FIG. 5) and to contract upward away from the wafer without having to stretch or without having to stretch significantly. Thus, the inner annular flexible membrane 500 can be made of inelastic material and still function properly, i.e., expand and contract. However, in some embodiments, the inner annular flexible membrane 500 can still be made of elastic material.

Figure 6A:
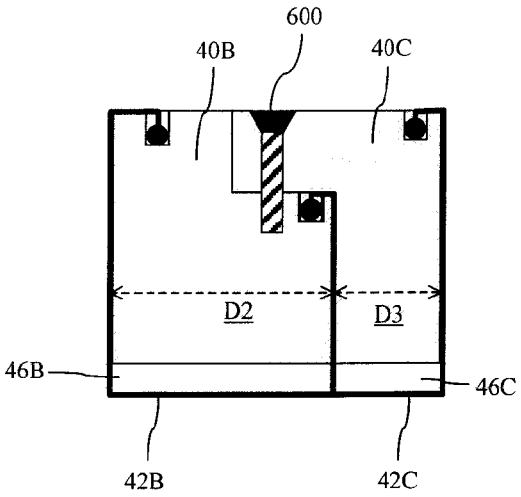
FIG. 6A is a cross-sectional view of an example of second and third annular discs with the second and third inner annular flexible membranes in accordance with an embodiment of the invention.
Figure 6B:
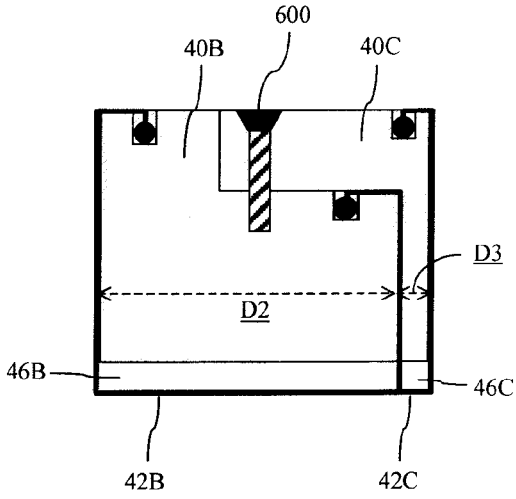
FIG. 6B is a cross-sectional view of another example of the second and third annular discs with the second and third inner annular flexible membranes in accordance with an embodiment of the invention.

Turning now to FIGS. 6A and 6B, an example of adjusting the widths of the second and third annular chambers 46B and 46C, which are defined by the annular discs 40B and 40C, respectively, is described. FIG. 6A shows a first set of the second and third annular discs 40B and 40C, which are coupled by a joint screw 600. FIG. 6B shows a second set of the second and third annular discs 40B and 40C, which are also coupled by the joint screw 600. In FIG. 6A, the width D2 of the second annular disc 40B is 13 mm and the width D3 of the third annular disc 40C is 7 mm. In FIG. 6B, the width D2 of the second annular disc 40B has been changed to 17 mm and the width D3 of the third annular disc 40C has been changed to 3 mm. Consequently, the widths of the second and third annular chambers 46B and 46C have been adjusted. However, the total width of the second and third annular discs 40B and 40C has not been changed. Thus, the widths of the second and third annular chambers 46B and 46C can be adjusted by changing only the annular discs 40B and 40C and the attached inner annular flexible membranes 42B and 42C. That is, the annular disc 40A and the inner annular flexible membrane 42A do not have to be changed to adjust the widths of the second and third annular chambers 46B and 46C.

Figure 7A:
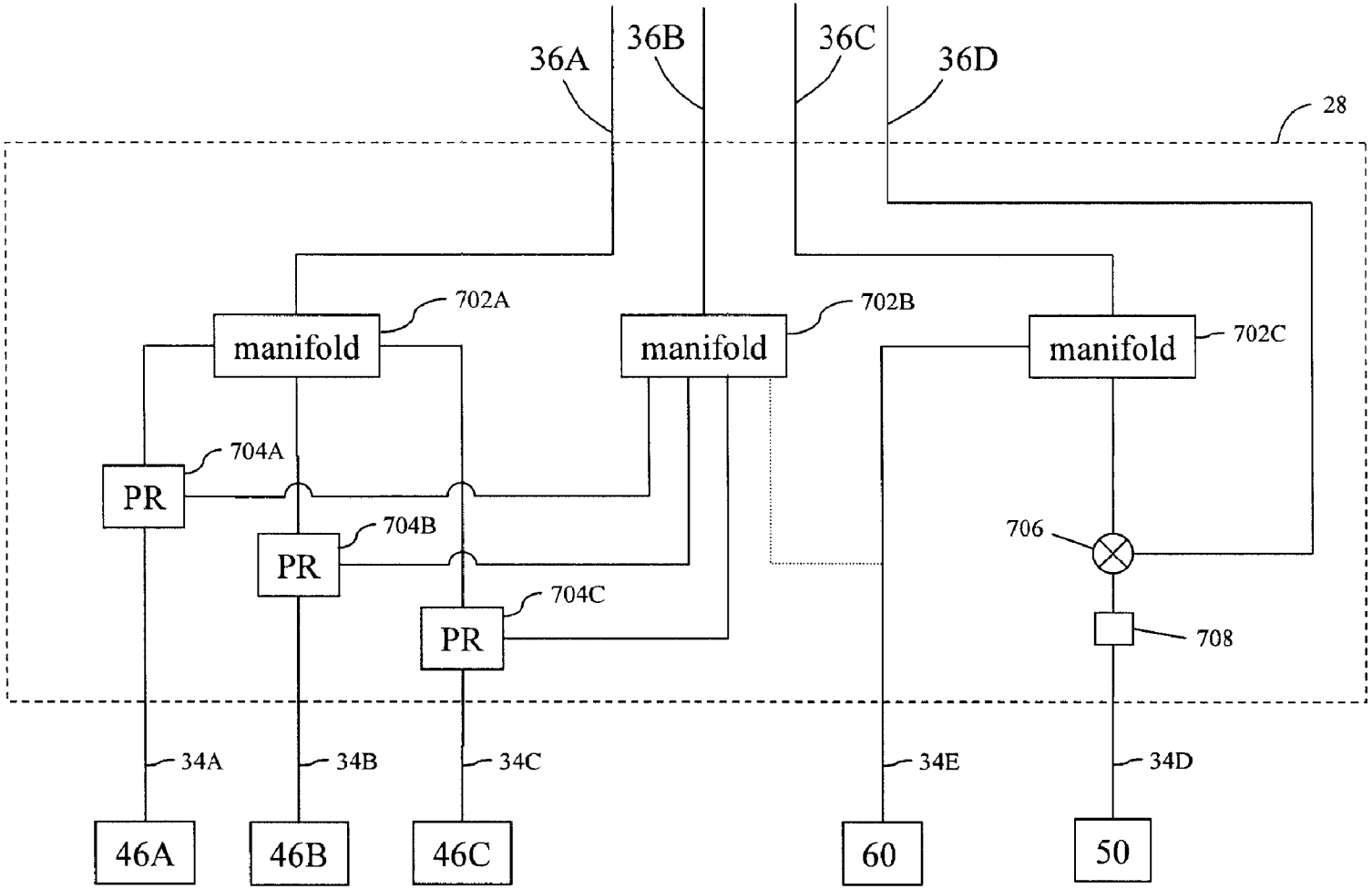
FIG. 7A is a block diagram of a valve-and-regulator assembly of the polishing head of FIG. 1 in accordance with an embodiment of the invention.

Turning now to FIG. 7A, the components of the valve-and-regulator assembly 28 in accordance with an embodiment of the invention are shown. The valve-and-regulator assembly 28 includes manifolds 702A, 702B and 702C, pressure regulators 704A, 704B and 704C, a three-way valve 706 and a water trap 708. The manifold 702A is connected to the fluid channel 36A to receive pressurized gas. The manifold 702A is also connected to the pressure regulators 704A, 704B and 704C to distribute the pressurized gas from the fluid channel 36A to the pressure regulators. The pressure regulators 704A, 704B and 704C are connected to the first, second and third annular chambers 46A, 46B and 46C, respectively, through the fluid channels 34A, 34B and 34C, respectively. The pressure regulators 704A, 704B and 704C are also connected to the manifold 702B, which is connected to the fluid channel 36B. The pressure regulator 704A is configured to selectively direct pressurized gas to the first annular chamber 46A. The pressure regular 704A is also configured to selectively release pressurized gas through the fluid channel 36B via the manifold 702B. Thus, the pressure regulator 704A can control the pressure within the first annular chamber 46A. Similarly, the pressure regulators 704B and 704C can control the pressure within the annular chambers 46B and 46C. Although not illustrated, the pressure regulators 704A-704C are connected to the controller 26 via the wires 32 (shown in FIG. 1) to receive power and control signals.

The manifold 702C is connected to the fluid channel 36C, which provides a vacuum/suction. The manifold 702C is also connected to the space 60 between the outer flexible membrane 44 and the inner annular flexible membranes 42A-42C via the fluid channel 34E to apply a vacuum/suction to the space 60. The space 60 may also be connected the manifold 702B such that the space 60 can be connected to the fluid channel 36B. The manifold 702C is also connected to the central cavity 50 via the fluid channel 34D through the valve 706 and the water trap 708 to apply a vacuum/suction to the cavity 50. The three-way valve 706 is connected to the manifold 702C and the central cavity 50 via the water trap 708. The three-way valve 706 is also connected to the fluid channel 36D to receive D.I. water. Thus, the valve 706 can selectively provide D.I. water to the central cavity 50 or apply a vacuum/suction to the central cavity 50. Although not illustrated, the three-way valve 706 is connected to the controller 26 via the wires 32 (shown in FIG. 1) to receive power and control signals. The water trap 708 is connected to the fluid channel 34D to trap contaminated water from the central cavity 50 when a vacuum/suction is being applied to the central cavity 50. The contaminated water in the water trap 708 can be released through the central cavity 50 by D.I. water received through the fluid channel 36D during an appropriate period.

Figure 7B:
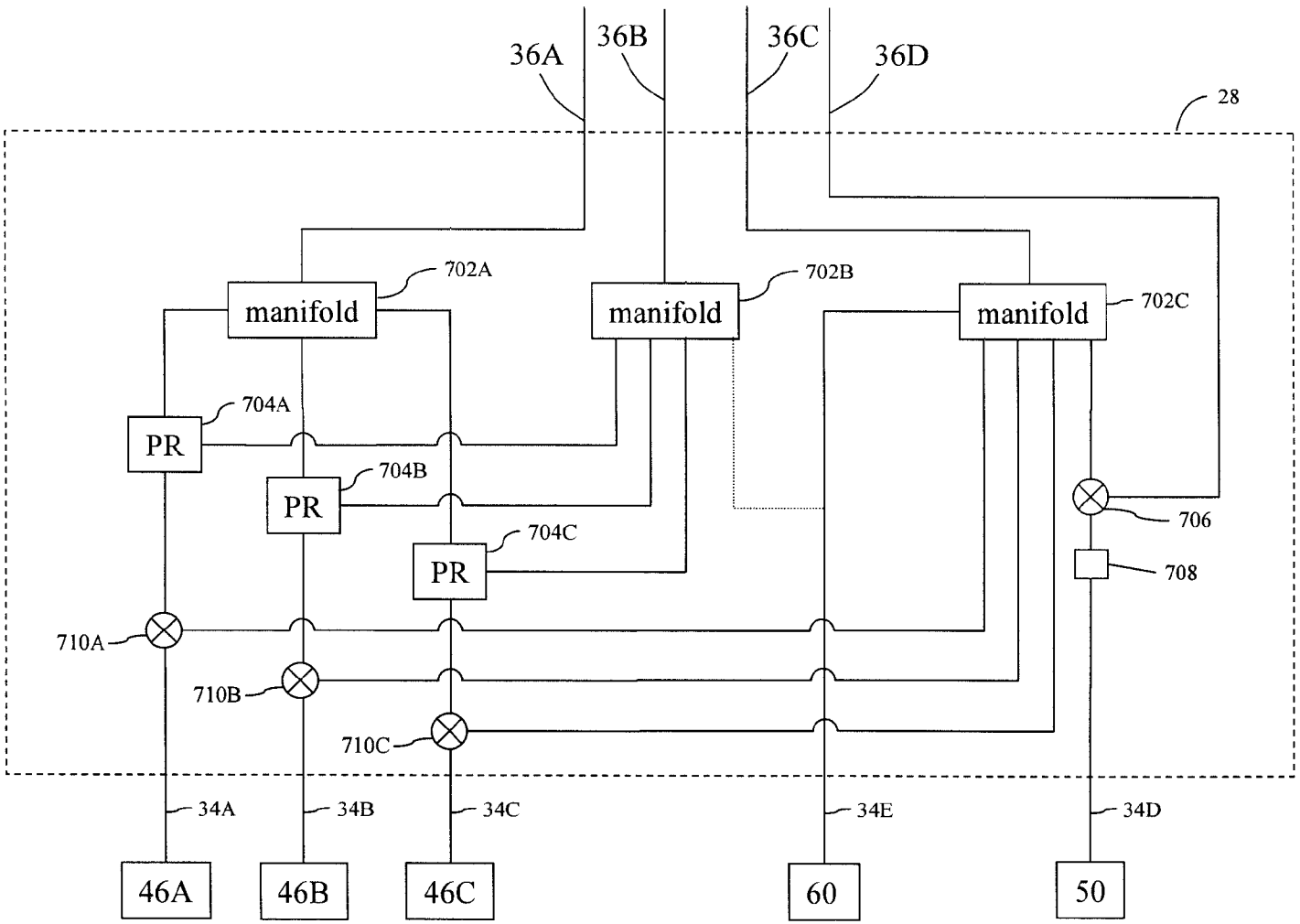
FIG. 7B is a block diagram of the valve-and-regulator assembly of the polishing head of FIG. 1 in accordance with an alternative embodiment of the invention.

Turning now to FIG. 7B, the components of the valve-and-regulator assembly 28 in accordance with an alternative embodiment of the invention are shown. In this alternative embodiment, the valve-and-regulator assembly 28 further includes three-way valves 710A, 710B and 710C. The three-way valve 710A is connected to the pressure regulator 704A, the manifold 702C and the first annular chamber 46A. Since the manifold 702C is connected to the fluid channel 36C, which provides a vacuum/suction, the three-way valve 710A is able to selectively connect the annular chamber 46A to the manifold 702C to apply suction to the first annular chamber 46A to deflate the annular chamber 46A. The three-way valve 710B is similarly connected to the pressure regulator 704B, the manifold 702C and the second annular chamber 46B, and the three-way valve 710C is similarly connected to the pressure regulator 704C, the manifold 702C and the third annular chamber 46C. Thus, the three-way valve 710B is able to selectively connect the second annular chamber 46B to the manifold 702C to apply suction to the second annular chamber to deflate the second annular chamber. Similarly, the three-way valve 710C is able to selectively connect the third annular chamber 46C to the manifold 702C to apply suction to the third annular chamber to deflate the third annular chamber.

Figure 8:
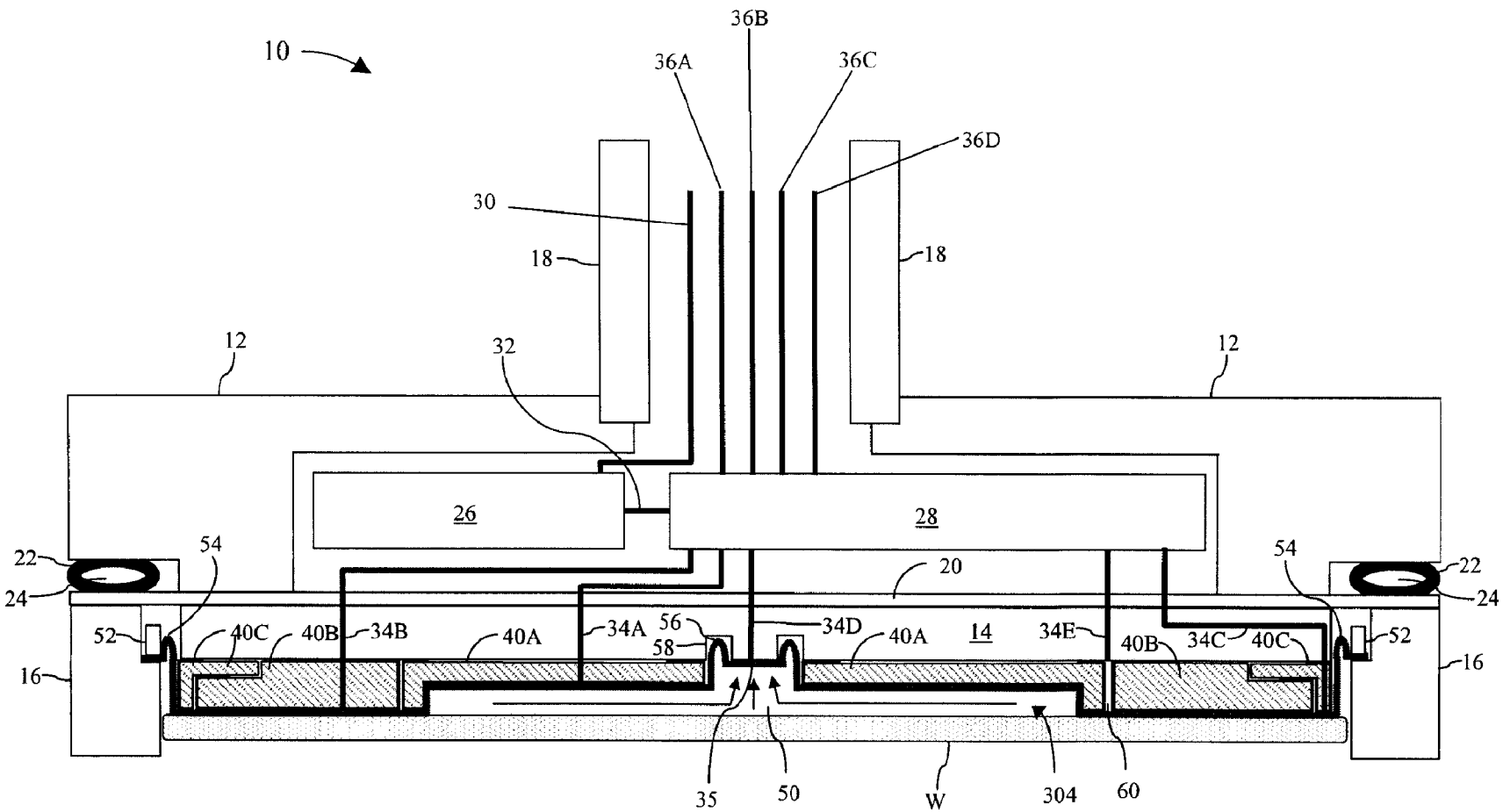
FIG. 8 is another vertical cross-sectional view of the polishing head of FIG. 1 with a semiconductor wafer chucked onto the polishing head in accordance with an embodiment of the present invention.

With reference to FIGS. 1 and 8, processes of chucking (loading) the wafer W onto the polishing head 10, polishing the wafer on the polishing surface 11 using the polishing head and de-chucking (unloading) the wafer from the polishing head are described. FIG. 8 shows a vertical cross-section of the polishing head 10, which has the wafer W chucked onto it. In FIG. 1, the outer flexible membrane 44 of the wafer carrier 10 is in contact with the back surface of wafer W.

In order to chuck the wafer W onto the polishing head 10, suction is applied to the central cavity 50 via the fluid channel 34D. Suction is also applied to the space 60 between the inner annular flexible membranes 42A-42C and the outer flexible membrane 44 via the fluid channel 34E. As a result, gas in the annular chambers 46A-46C is evacuated and the annular chambers 46A-46C are deflated, as illustrated in FIG. 8. Alternatively, suction is applied directly to the annular chambers 46A-46C via the fluid channels 34A-34C, respectively, to evacuate the gas in the annular chambers and deflate the annular chambers. Suction can also be applied to the space 60 between the inner annular flexible membranes 42A-42C and the outer flexible membrane 44 to further assist in deflating the annular chambers 46A-46C.

As the annular chambers 46A-46C are deflated, the inner annular flexible membrane 42A and the outer flexible membrane 44 are sucked into the circular recess region 304 of the first annular disc 40A, forming a large circular depression on the bottom surface of the outer flexible membrane that conforms to the circular recess region 304. In effect, the circular depression formed on the bottom surface of the outer flexible membrane 44 increases the size or diameter of the central cavity 50. As a result of the suction, a vacuum is created in the central cavity 50 between the outer flexible membrane 44 and the back surface of the wafer W, which causes the wafer to be chucked onto the polishing head 10. The circular recess region 304 of the first annular disc 40A allows more area of the wafer W to be subjected to the suction, which increase chucking power of the polishing head. The circular recess region 304 allows the polishing head 10 to have a smaller central cavity 50. As an example, the diameter of the central cavity 50 may be less than 5 mm, e.g., 2.5 mm. In a conventional polishing head, the diameter of a similar central cavity is typically much greater than 5 mm, e.g., 10 mm, so that the suction created in the central cavity has enough suction power to chuck a semiconductor wafer. Since the diameter of the central cavity is relatively large, the conventional polishing head may need to provide pressure in the central cavity during a wafer polishing process to provide sufficient downward force to the zone of a semiconductor wafer below the central cavity. However, such pressure in the central cavity 50 of the polishing head 10 is not necessary since the central cavity 50 is sufficiently small.

In order to polish the wafer W on the polishing surface 11, the polishing head 10 with the chucked wafer is moved over the polishing surface. The polishing head 10 is then lowered onto the polishing surface 11 such that the retainer ring 16 contacts the polishing surface. Next, the first, second and third annular chambers 46A-46C are inflated by supplying pressurized gas with same or different pressures to the annular chambers 46A-46C through the pressure regulators 704A-704C, respectively, of the valve-and-regulator assembly 28. As a result, the annular chambers 46A-46C are inflated, which push the bottom surface of the outer flexible membrane 44 toward the polishing surface 11, and thus, applies same or different pressures to the wafer on the polishing surface 11 during the polishing process.

In this manner, the pressures applied to the wafer W can be controlled in terms of zones of the wafer. The pressure applied to a central zone that is under the first annular chamber 46A is controlled by the pressure in that chamber. The pressure applied to an intermediate annular zone surrounding the central zone that is under the second annular chamber 46B is controlled by that chamber. The pressure applied to an outer annular zone surrounding the intermediate annular zone that is under the third annular chamber 46C is controlled by that chamber. By applying different pressures to the respective zones, polishing rates at the respective zones can be controlled individually.

As the bottom surface of the outer flexible membrane 44 is pushed downward, the shapes of the annular upside down U-shaped portions 54 and 56 of the outer flexible membrane 44 are changed such that the heights of these upside down U-shaped portions are decreased. That is, the annular upside down U-shaped portions 54 and 56 of the outer flexible membrane 44 are at least partially straightened. These changes in shape of the annular upside down U-shaped portions 54 and 56 allow the bottom surface of the outer flexible membrane 44 to move downward more easily. Without the upside down U-shaped portions 54 and 56, the sidewalls of the outer flexible membrane 44 need to be elongated or stretched, which would not allow the bottom surface of the outer flexible membrane 44 to move downward easily.

During the polishing process, the suction applied to the central cavity 50 may be removed. Alternatively, instead of removing the suction applied to the central cavity 50 during the polishing process, the applied suction can be used to detect wafer slippage. If the wafer W is slipped out from the polishing head 10 during the polishing process, the pressure of the suction will be changed. By detecting this pressure change, the wafer slippage can be detected.

After the polishing process is finished, the suction is again applied to the central cavity 50 in order to hold the wafer W. After the wafer is held by the suction onto the outer flexible membrane 44, the pressurized gas is no longer applied to the first, second and third annular chambers 46A-46C. In addition, another suction is applied to the space 60 between the inner annular flexible membranes 42A-42C and the outer flexible membrane 44 to deflate the annular chambers 46A-46C, which raises the bottom surface of the outer membrane 44 toward the base 14. Since the suction applied to the central cavity 50 attracts the wafer toward the base 14, the wafer is lifted from the polishing surface 11 and moved toward the base 14 as the annular chambers 46A-46C are deflated.

As the bottom surface of the outer flexible membrane 44 is moved upward, the shapes of the annular upside down U-shaped portions 54 and 56 of the outer flexible membrane are recovered to their original upside down U-shapes.

Next, the polishing head 10 is transferred to a wafer unload station (not shown) and then the wafer is unloaded or de-chucked to the wafer unload station. In order to de-chuck the wafer from the polishing head 10, the suction is no longer applied to the central cavity 50 and the space 60 between the inner annular flexible membranes 42A-42C and the outer flexible membrane 44. Furthermore, pressurized gas is applied to at least one of the inner annular flexible membranes 42A-42C through the respective fluid channels 34A-34C in order to unload the wafer onto the wafer unload station. Alternatively, D.I. water can be applied to the wafer through the central cavity 50 via the fluid channel 34 D in order to unload the wafer onto the wafer unload station.

Figure 9:
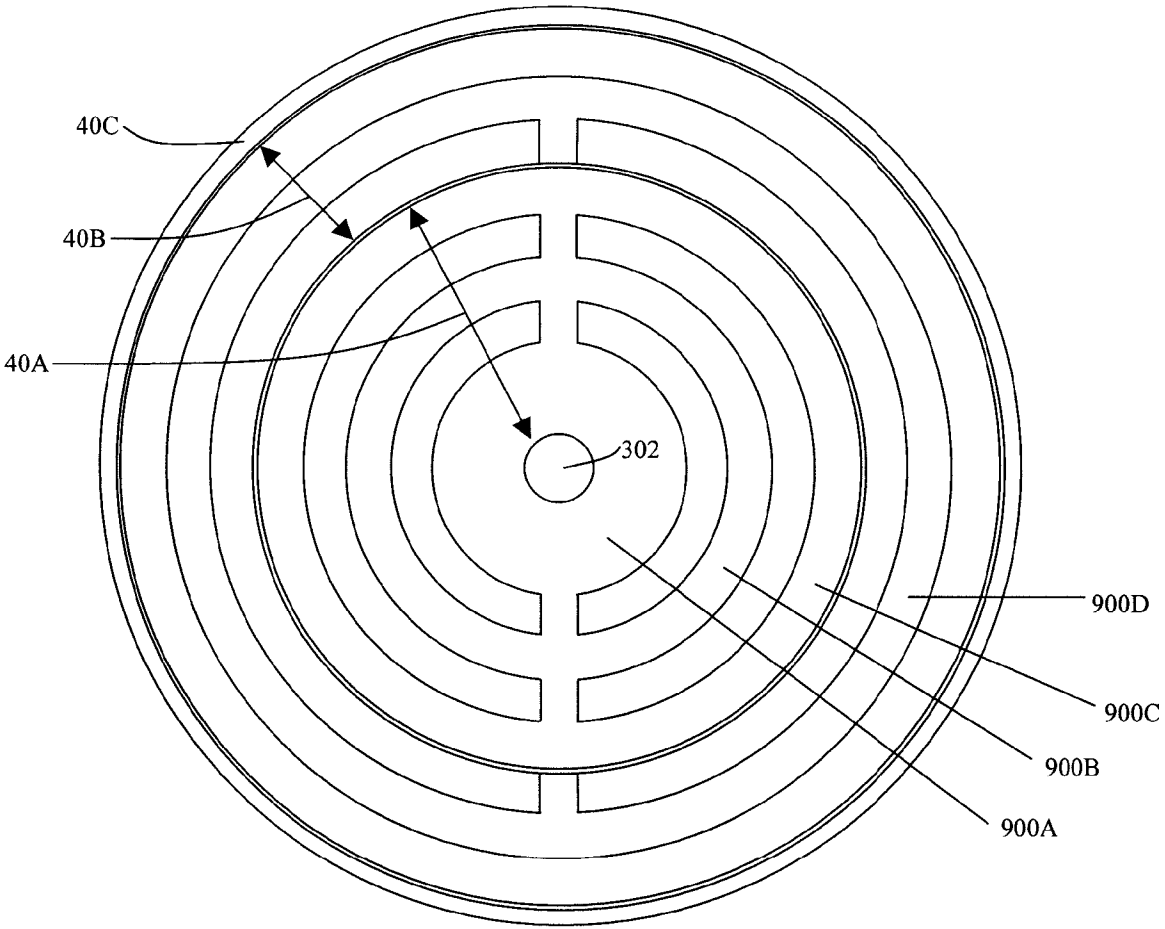
FIG. 9 is a bottom view of the first, second and third annular discs with interconnected recess regions in accordance with an embodiment of the invention.

Turning now to FIG. 9, the first, second and third annular discs 40A-40C in accordance with another embodiment of the invention are shown. In this embodiment, at least some of the annular discs 40A-40C are configured to include interconnected recess regions 900A-900D. The interconnected recess regions 900A-900D of the first, second and third annular discs 40A-40C are similar to the recess region 304 of the first annular disc 40A, which is illustrated in FIGS. 3A and 3B. The interconnected recess regions 900A-900D of the first, second and third annular discs 40A-40C allow the outer flexible membrane 44, as well as the inner annular flexible membranes 42A-42C, to conform to the interconnected recess regions 900A-900D when the inner annular flexible membranes 42A-42C are deflated and suction is applied to one or more of the annular chambers 46A-46C and/or the space 60 between the inner annular flexible membranes 42-42C and the outer flexible membrane 44.

Figure 10:
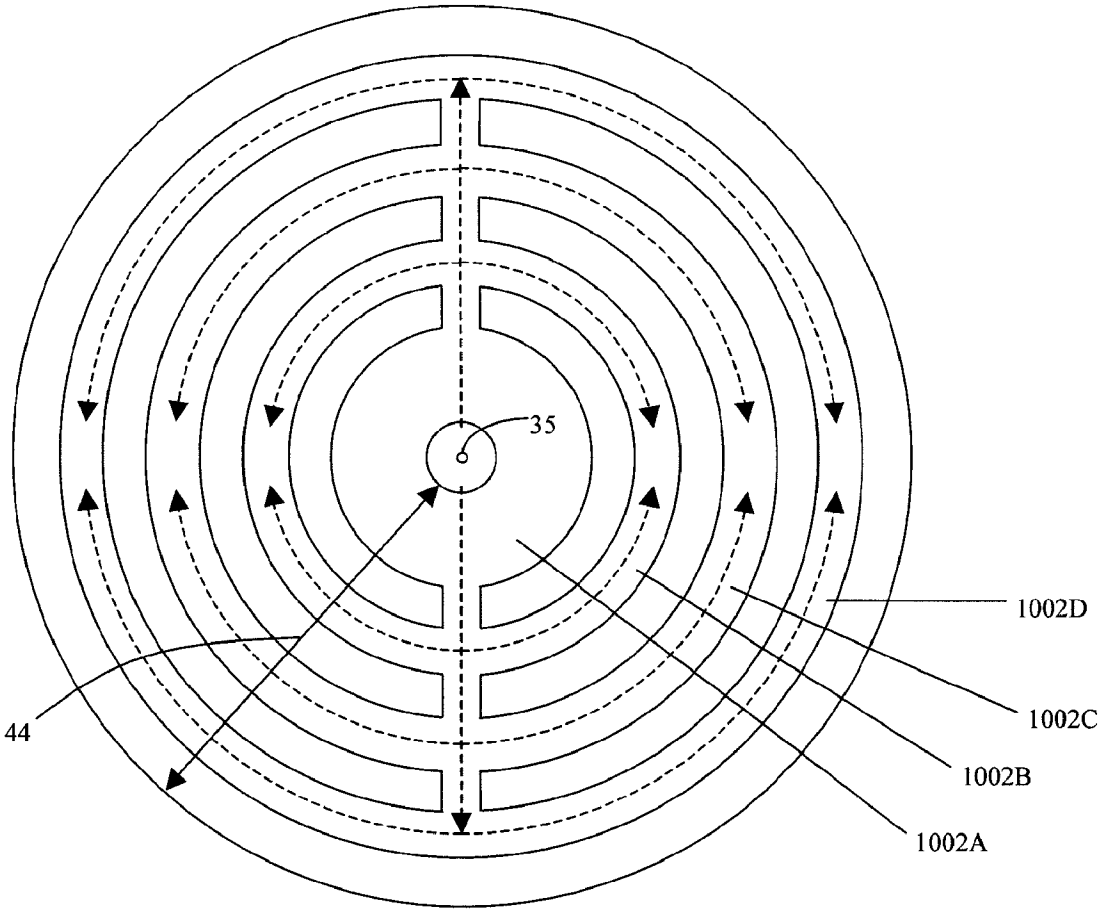
FIG. 10 is a bottom view of the outer flexible membrane that has conformed to the interconnected recess regions of the annular discs in accordance with an embodiment of the invention.

As illustrated in FIG. 10, when the outer flexible membrane 44 is conformed to the interconnected recess regions 900 due to the applied suction, the lower surface of the outer flexible membrane 44 forms interconnected depressions 1002A-1002D, which allow a vacuum to be created in the interconnected depressions 1002A-1002D through the opening 35 of the fluid channel 34D when a wafer is in contact with the outer flexible membrane. Since the interconnected recess regions 900A-900D are distributed throughout the annular discs 40A-40C, the corresponding interconnected depressions are also distributed throughout the lower surface of the outer flexible membrane 44. Thus, when a wafer is in contact with the lower surface of the outer flexible membrane 44 and suction is applied to the interconnected depressions 1002A-1002D, a vacuum can be created and applied over most of the back surface of the wafer. In effect, the vacuum in the interconnected depressions 1002A-1002D creates a bond between the wafer and the outer flexible membrane 44 over a large area of the wafer that corresponds to the area of the interconnected depressions 1002A-1002D.

In FIG. 9, the interconnected recess regions 900A-900D include a circular recess region 900A and annular recess regions 900B and 900C, which are located on the bottom surface of the annular disc 40A. In addition, the interconnected recess regions 900A-900D include an annular recess regions 900D, which is located on the bottom surface of the annular disc 40B. In this illustrated embodiment, there are no recess regions on the bottom surface of the annular disc 40C. However, in other embodiments, the annular disc 40C may include one or more interconnected recess regions.

In other embodiments, one or more of the annular discs 40A-40C may have interconnected recess regions having different configurations than the interconnected recess regions 900A-900D. As an example, one or more of the annular discs 40A-40C may have interconnected recess regions that extend in a radial direction. As another example, one or more of the annular discs 40A-40C may have interconnected recess regions that are geometrical in shape.

The operation of a polishing head with the annular discs 40A-40C of FIG. 9 is similar to the operation of the polishing head 10 of FIG. 1. Thus, the chucking process, the polishing process and the de-chucking process using the polishing head with the annular discs 40A-40C of FIG. 9 are similar to the corresponding processes using the polishing head 10 of FIG. 1.

A concern with the polishing head 10 using the annular discs 40A-40C of FIG. 1 or FIG. 9 is that the third annular chamber 46C defined by the third inner annular flexible membrane 42C may over inflate when the pressure in the third annular chamber 46C is significantly higher than the pressure in the second annular chamber 46B. As a result, the thickness of the third annular chamber 46C may be greater than the desired thickness D3, which is illustrated in FIG. 2.

Figure 11B:
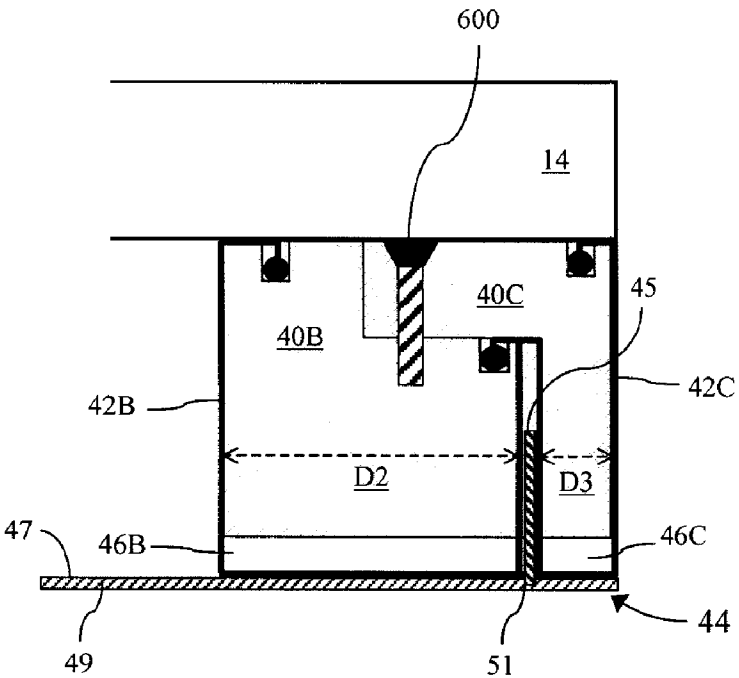
FIG. 11B is a cross-sectional view showing the portion of the outer flexible membrane with the annular flap in accordance with an alternative embodiment of the invention.
Figure 11A:
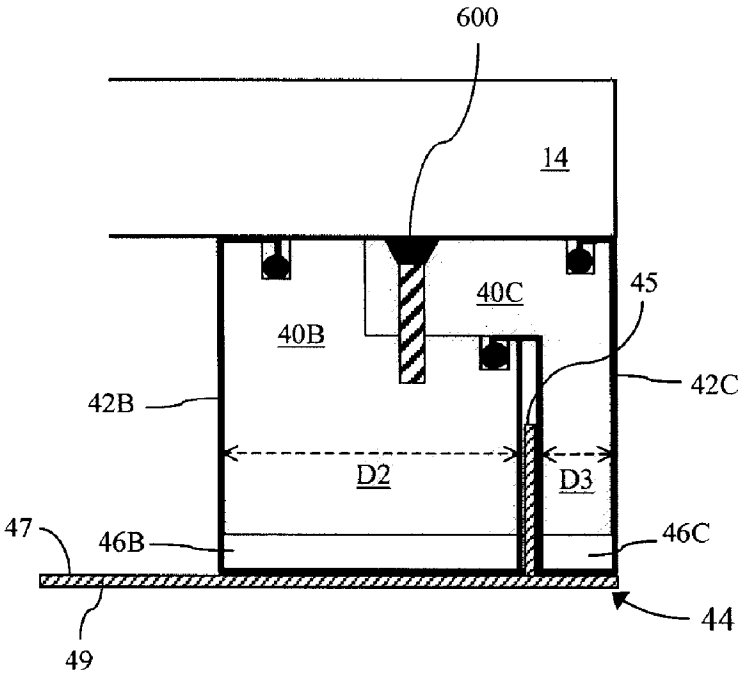
FIG. 11A is a cross-sectional view showing a portion of the outer flexible membrane with an annular flap in accordance with an embodiment of the invention.

Turning now to FIG. 11A, a portion of the outer flexible membrane 44 in accordance with an embodiment of the invention is shown. In this embodiment, the outer flexible membrane 44 includes an annular flap 45 that extends upward toward the base 14. The annular flap 45 is attached to the upper surface 47 of the lower portion 49 of the outer flexible membrane 44 such that the annular flap is positioned between adjacent sidewalls of the second and third inner annular flexible membranes 42B and 42C. The annular flap 45 provides a barrier between the second annular chamber 46B produced by the second inner annular flexible membrane 42B and the third annular chamber 46C produced by the third inner annular flexible membrane 42C so that the third annular chamber does not over inflate into the region below the lower surface of the second annular disc 40B for the second annular chamber. Thus, the annular flap 45 of the outer flexible membrane 44 serves to maintain the thickness D3 of the third annular chamber 46C even when the pressure in the third annular chamber is significantly higher than the pressure in the second annular chamber 46B, which allows the polishing head 10 to control the zone of the wafer that is affected by the third annular chamber during polishing. In the embodiment shown in FIG. 11A, the annular flap 45 is an integral part of the outer flexible membrane 44. That is, the outer flexible membrane 44 with the annular flap 45 is made of a single piece of material. Thus, in this embodiment, the annular flap 45 is made of the same material as the rest of the outer flexible membrane 44.

In an alternative embodiment, the annular flap 45 of the outer flexible membrane 44 may be a separate piece that is attached to bottom portion 49 of the outer flexible membrane, as illustrated in FIG. 11B. In this embodiment, the bottom portion 49 of the outer flexible membrane 44 includes an annular groove 51 on its upper surface 47. The annular flap 45 is situated in the annular groove 51 of the bottom portion 49 of the outer flexible membrane 44. The annular flap 45 may be attached to the bottom portion 49 of the outer flexible membrane 44 using an adhesive material. In this embodiment, the annular flap 45 can be made of a material that is different than the rest of the outer flexible membrane 44. As an example, the annular flap 45 can be made of a material that is harder than the material for the rest of the outer flexible membrane 44 to provide a stronger barrier between the second annular chamber 46B and the third annular chamber 46C.

Figure 12:
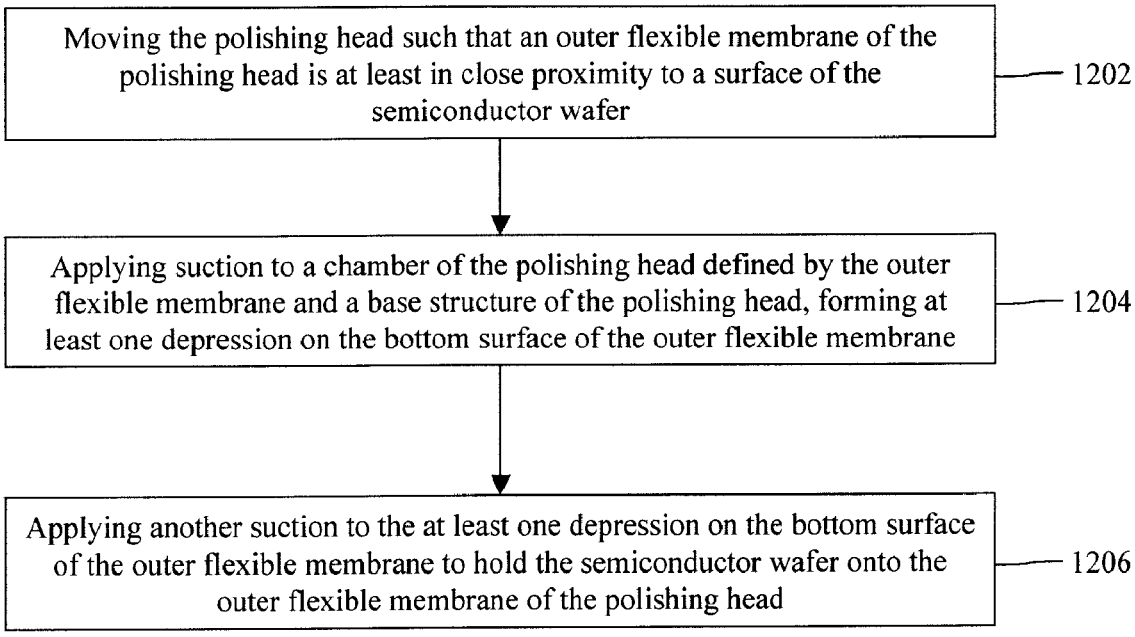
FIG. 12 is a process flow diagram of a method of handling and polishing a semiconductor wafer in accordance with an embodiment of the invention.

With reference to a process flow diagram of FIG. 12, a method for handling and polishing a semiconductor wafer using a polishing head is described. At block 1202, the polishing head is moved such that an outer flexible membrane of the polishing head is at least in close proximity to a surface of the semiconductor wafer. Next, at block 1204, suction is applied to a chamber of the polishing head defined by the outer flexible membrane and a base structure of the polishing head. The base structure is configured to include at least one recess region on a lower surface of the base structure. The applying of the suction to the chamber causes the outer flexible membrane to conform to the at least one recess region of the base structure such that at least one depression is formed on a bottom surface of the outer flexible membrane. Next, at block 1206, another suction is applied to the at least one depression on the bottom surface of the outer flexible membrane to hold the semiconductor wafer onto the outer flexible membrane of the polishing head.

Although the foregoing description sets forth preferred exemplary embodiments and methods of operation of the invention, the scope of the invention is not limited to these specific embodiments or described methods of operation. Many details have been disclosed that are not necessary to practice the invention, but have been included to sufficiently disclose the best mode of operation and manner and process of making and using the invention. Modification may be made to the specific form and design of the invention without departing from its spirit and scope as expressed in the following claims.

What is claimed is:

1. A polishing head comprising:

a base structure having a lower surface, said base structure being configured to include at least one recess region on said lower surface;

an outer flexible membrane positioned below said base structure, said outer flexible membrane and said base structure defining a chamber below said base structure;

a first fluid channel operatively connected to said chamber to apply suction to at least a portion of said chamber, said suction causing said outer flexible membrane to conform to said at least one recess region of said base structure such that at least one depression is formed on a bottom surface of said outer flexible membrane; and a second fluid channel configured to extend through said outer flexible membrane such that an opening of said second fluid channel is positioned in said at least one depression when said suction is applied to said chamber, said second fluid channel being used to apply another suction to said at least one depression to hold a semiconductor wafer onto said outer flexible membrane.

2. The polishing head of claim 1 wherein said at least one recess region includes a circular recess region near the center of said base structure such that said at least one depression includes a circular depression.

3. The polishing head of claim 1 wherein said at least one recess region includes interconnected recess regions such that said at least one depression includes interconnected depressions.

4. The polishing head of claim 3 wherein said interconnected recess regions include one or more annular recess regions.

5. The polishing head of claim 1 wherein said base structure includes a base and a plurality of annular discs attached to said base, at least some of said annular discs including said at least one recess region.

6. The polishing head of claim 1 further comprising a housing attached to said base structure and a valve-and-regulator assembly positioned within said housing, said valve-and-regulator assembly being connected to said first and second fluid channels.

7. The polishing head of claim 6 further comprising a retainer ring positioned below said housing and a circular tube positioned between said housing and said retainer ring.

8. The polishing head of claim 7 further comprising a flexure attached to said retainer ring and said housing.

9. The polishing head of claim 1 wherein said outer flexible membrane is configured to include an annular upside down U-shaped portion.

10. The polishing head of claim 1 further comprising a plurality of inner annular flexible membranes attached to said base structure, said inner annular flexible membranes being positioned within said outer flexible membrane, each of said inner annular flexible membranes defining an annular chamber that is connected to a fluid channel.

11. The polishing head of claim 10 wherein said outer flexible membrane includes an annular flap configured to extend toward said base structure, said annular flap being positioned between adjacent sidewalls of said inner annular flexible membranes.

12. The polishing head of claim 10 wherein the thicknesses of said inner annular flexible membranes are thinner than the thickness of said outer flexible membrane.

13. The polishing head of claim 10 wherein at least one of said inner annular flexible membranes includes an annular wrinkled portion on a sidewall.

14. The polishing head of claim 1 wherein said base structure includes a base and at least first and second annular discs attached to said base, an outer edge of said first annular disc being configured to include a step and an inner edge of said second annular disc being configured to include an inverted step such that said step of said first annular disc fits said inverted step of said second annular disc.

15. A method for handling and polishing a semiconductor wafer using a polishing head, said method comprising:

moving said polishing head such that an outer flexible membrane of said polishing head is at least in close proximity to a surface of said semiconductor wafer;

applying suction to at least a portion of a chamber of said polishing head defined by said outer flexible membrane and a base structure of said polishing head through a first fluid channel, said base structure being configured to include at least one recess region on a lower surface of said base structure, said applying of said suction to at least said portion of said chamber causing said outer flexible membrane to conform to said at least one recess region of said base structure such that at least one depression is formed on a bottom surface of said outer flexible membrane; and applying another suction to said at least one depression on said bottom surface of said outer flexible membrane through a second fluid channel to hold said semiconductor wafer onto said outer flexible membrane of said polishing head, said second fluid channel being configured to extend through said outer flexible membrane such that an opening of said second fluid channel is positioned in said at least one depression when said suction is applied to said chamber.

16. The method of claim 15 wherein said at least one recess region includes a circular recess region near the center of said base structure such that said at least one depression includes a circular depression.

17. The method of claim 15 wherein said at least one recess region includes interconnected recess regions such that said at least one depression includes interconnected depressions.

18. The method of claim 17 wherein said interconnected recess regions of said base structure include one or more annular recess regions.

19. The method of claim 15 wherein said base structure includes a base and a plurality of annular discs attached to said base, at least some of said annular discs including said at least one recess region.

20. The method of claim 15 further comprising absorbing vibrations of a retainer ring of said polishing head at a sealed annular tube positioned over said retainer ring.

21. The method of claim 15 further comprising expanding said outer flexible membrane, including straightening an annular upside down U-shaped portion of said outer flexible membrane.

22. The method of claim 15 further comprising applying pressurized gas to annular chambers of said polishing head, said annular chambers being defined by a plurality of inner annular flexible membranes and said base structure, said inner annular flexible membranes being positioned within said outer flexible membrane.

23. The method of claim 22 wherein said applying said pressurized gas includes controlling pressures in said annular chambers using said pressurized gas.

24. The method of claim 22 further comprising expanding a particular annular chamber of said annular chambers, including straightening an annular wrinkled portion of one of said inner annular flexible membranes associated with said particular annular chamber.

25. The method of claim 15 wherein said applying said suction to at least said portion of said chamber includes applying said suction to a space between said outer flexible membrane and a plurality of inner annular flexible membranes, said inner annular flexible membranes being positioned within said outer flexible membrane.

26. The method of claim 15 wherein said applying said suction to at least said portion of said chamber includes applying suction to at least one of annular chambers of said polishing head, said annular chambers being defined by a plurality of inner annular flexible membranes and said base structure, said inner annular flexible membranes being positioned within said outer flexible membrane.

* * * * *